United States Patent [19]

Cramer

[11] 4,184,684

[45] Jan. 22, 1980

[54] CARD GAME BOARD APPARATUS

[76] Inventor: Lyle L. Cramer, 2060 E. Boatfield, Burton, Mich. 48529

[21] Appl. No.: 850,393

[22] Filed: Nov. 10, 1977

[51] Int. Cl.[2] ..... A63F 1/10

[52] U.S. Cl. ..... 273/148 A

[58] Field of Search ..... 273/148 A, 150, 274

[56] References Cited

U.S. PATENT DOCUMENTS

| | | | |
|---|---|---|---|
| 942,667 | 12/1909 | Smith | 273/150 |
| 2,081,520 | 5/1937 | Warner | 273/148 A |
| 2,624,582 | 1/1953 | Molinar | 273/150 X |
| 3,011,789 | 12/1961 | Eliassen et al. | 273/148 R X |
| 4,006,905 | 2/1977 | Marbury | 273/150 X |

FOREIGN PATENT DOCUMENTS

| | | | |
|---|---|---|---|
| 19657 | 8/1909 | United Kingdom | 273/150 |

*Primary Examiner*—Anton O. Oechsle
*Attorney, Agent, or Firm*—Gifford, Chandler, VanOphem, Sheridan & Sprinkle

[57] ABSTRACT

A game board used in combination with two or more conventional decks of cards to play a form of solitaire, the object of which is to be the first player to distribute all of the cards in his possession. Use of the game board offers the players a greater number of possible plays on each turn than in previously known forms of solitaire, yet allows penalties to be assessed for not recognizing or exercising all opportunities to play during a player's turn. Furthermore, the board contains a plurality of various card placement positions organized to aid the participants in recognizing possible playing opportunities.

11 Claims, 3 Drawing Figures

CARD GAME BOARD APPARATUS

BACKGROUND OF THE INVENTION

I. Field of the Invention

The invention relates generally to amusement devices and more particularly, to an improved card game and game board apparatus for use therewith.

II. Description of the Prior Art

"Solitaire" card games, although originally conceived for the entertainment and amusement of a single player, have often been adapted so that several players can participate and compete against each other. Generally, the players distribute the cards dealt to them as their hand in orderly progression upon stacks of cards provided at the center of the playing area. Generally, a plurality of stacks of playing cards are placed face down in the center of the playing area with the top card in each stack facing up. At each turn, a player exposes the top card from his stack (his hand) and attempts to place it onto the stacks such that the sequence of face up cards on each stack numerically descends in consecutive order, i.e., King, Queen, Jack, 10, etc., as well as alternating color. Whenever an Ace is exposed, it is immediately placed face up on the playing surface to form a new stack upon which cards of the same suit as the Ace are placed in consecutively ascending numerical order, i.e., 2, 3, etc. The object of the game is to be the first player with no cards remaining in his hand.

These previously known "Solitaire" games limit the player's ability to distribute the cards in his hand by offering only two card placement positions, i.e., either upon the predetermined number of original stacks or upon the Ace stacks once the Aces are exposed. A further disadvantage of previously known Solitaire games is that once an original playing stack has been deleted, it may be replaced only by placing a King in the position of the original stack.

A still further disadvantage of these previously known Solitaire games is that when two or more decks of conventional playing cards are used and the number of original playing stacks is accordingly increased, the arrangement of original playing stacks becomes disorderly. This disorder results in increased confusion of the game and the increased possibility that a player may not recognize a playing opportunity during the course of the game. When a player fails to execute a playing opportunity, he not only fails to increase his chances of winning but he can also hinder succeeding playing opportunities for the other participants.

SUMMARY OF THE PRESENT INVENTION

The present invention overcomes the above mentioned disadvantages by providing a game board apparatus having an orderly arrangement of numerous card placement positions. This orderly arrangement enables a player to more easily recognize and act upon playing opportunities. This ability to recognize playing possibilities serves a two fold purpose. First, it promotes faster and more complete utilization of possible playing opportunities. Secondly, it requires more astute game play since, according to the present invention, if a player fails to timely execute a possible play and such failure is noticed by another participant, the faulting player is penalized by losing his turn and receiving a card from each participant. Consequently, the disadvantage to succeeding players caused by failure of the faulting player to make a possible move is minimized.

In addition, the present invention provides more card playing opportunities than the previously known Solitaire games. These additional opportunities comprise card placement positions located on the playing surface not only for original playing stacks and Ace stacks, but also for separate King stacks and for an additional exposed card stack for each participant.

The game board apparatus generally comprises a rectangular playing board having a playing surface. The playing board may be made of cardboard, wood, paper, plastic or any other suitable material which enables the playing surface to be placed on and supported by a table for convenient seating of game participants. This playing surface is provided with means to define distinct card placement positions. The card placement positions are arranged into five distinct sets on the playing surface and each position is preferably outlined as the profile of a conventional playing card.

A set of first card placement positions is provided along the longitudinal centerline of the playing surface. These card placement positions are linearly spaced apart and provide a plurality of positions on each of which a card is placed face up at the beginning of the game and before the remaining cards are dealt to the players. Cards are subsequently accumulated on these first card placement positions in consecutively descending numerical order but consecutively alternating colors.

A set of second card placement positions is equally divided on both sides of the set of first card placement positions. The number of second card placement positions corresponds to the number of Aces in the playing deck used and each position designates a particular Ace which is to be placed thereon once it is exposed. Once an Ace has been placed on its corresponding placement position, cards of the same suit are subsequently accumulated thereon in consecutively ascending numerical order.

A set of third card placement positions is provided diagonally inwardly from each corner of the playing surface. The number of third card placement positions corresponds to the number of Kings in the playing deck used and each position designates a particular King which is to be placed thereon once it is exposed. Once a King has been placed on its corresponding third card placement position, cards of alternating color are subsequently accumulated in consecutively descending numerical order.

A set of fourth card placement positions is arranged to provide one such position near the edge of the playing surface at each participant's seating position. The number of seating positions available depends upon the number of standard card decks which are used as the playing deck, as will be discussed hereinafter. At the start of the game, and after a card has been placed in each of the first card placement positions, the remaining cards are dealt to the participants and are placed face down on each participant's fourth card placement position.

A set of fifth card placement positions equal in number to the fourth card placement positions is provided adjacent to but spaced inwardly from the set of fourth card placement positions. A card taken from a player's fourth card placement position, and not playable on a first, second or third card placement position is placed face up in that player's fifth card placement position.

Alternatively this last mentioned card can be placed face up in an opponent's fifth card placement position if it is opposite in color to and of consecutively ascending or descending numerical order to the top exposed card on the opponent's fifth card placement position.

The game board apparatus of the present invention can be used to play the following games:

MASTER SOLITAIRE—Four conventional decks of playing cards are used as the playing deck, and only two participants compete. The playing surface contains twelve first card placement positions, sixteen second and sixteen third card placement positions, two fourth and two fifth card placement positions.

DOUBLE SOLITAIRE—Two conventional decks of playing cards are used as the playing deck, and from two to four participants can play. The playing surface contains four first card placement positions, eight second and eight third card placement positions, and four fourth and four fifth card placement positions.

TRIPLE SOLITAIRE—Three standard card decks are used as the playing deck, and from two to six participants can play. The playing surface contains eight first card placement positions, twelve second and twelve third card placement positions, and six fourth and six fifth card placement positions.

BRIEF DESCRIPTION OF THE DRAWINGS

The game board apparatus of the present invention will be more clearly understood by reference to the following detailed description when read in conjunction with the accompanying drawings, wherein like reference characters refer to like parts throughout the several views, and in which.

DETAILED DESCRIPTION OF THE PRESENT INVENTION

Figure 1:
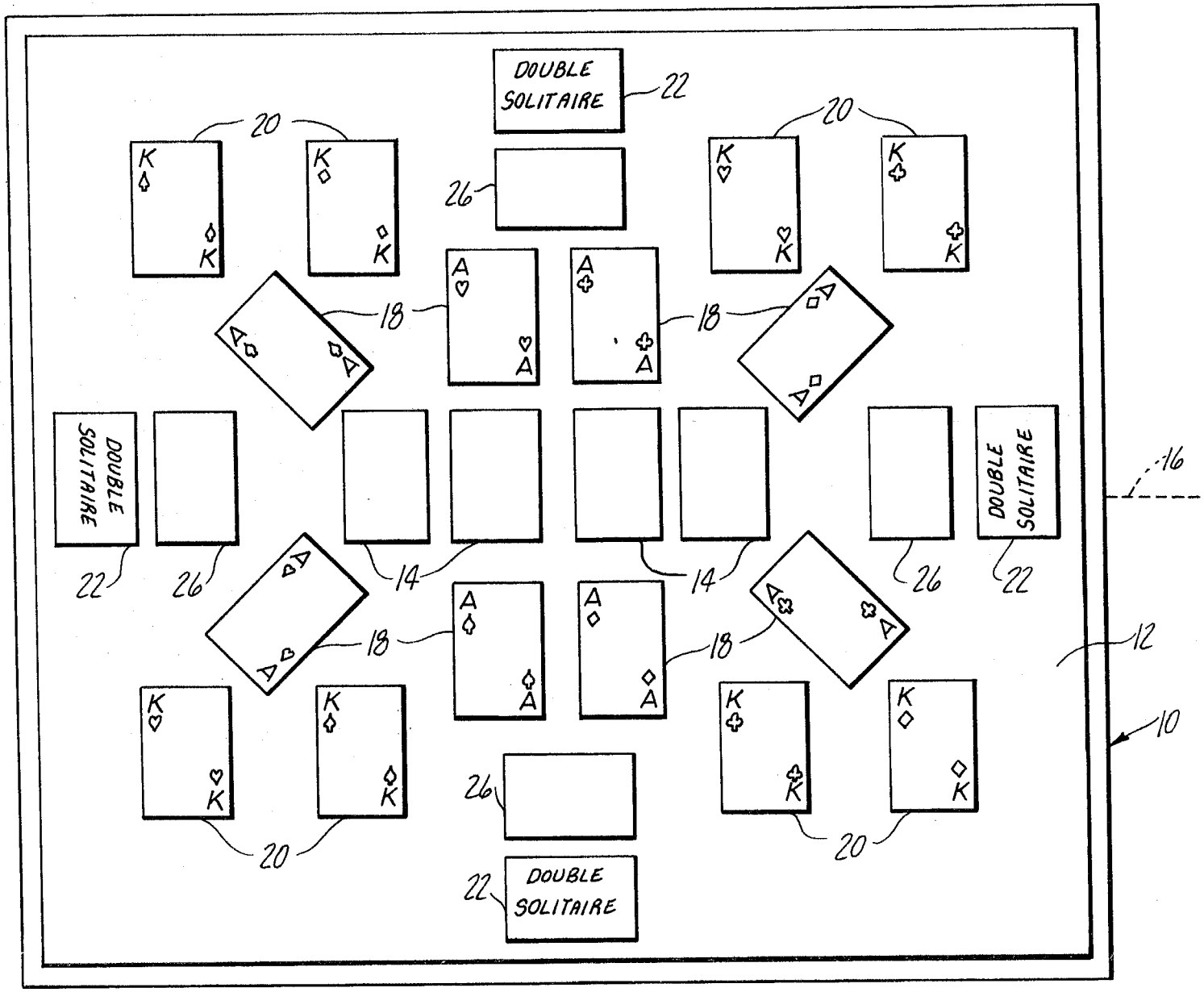
FIG. 1 is a top plan view of the game board of the present invention.

Referring now to FIG. 1, a substantially rectangular game board 10 according to the present invention is thereshown having a playing surface 12. The board 10 is made of cardboard, wood, paper, plastic or any other suitable flat material which preferably can be placed on a table.

At the center of the playing surface 12 four first card placement positions 14 are linearly spaced apart along a longitudinal centerline 16 of the playing surface 12. As will be later more fully described, a card from a subsequently described playing deck is placed face up on each of these first card placement positions 12 prior to distribution of the playing deck to the players.

Four second card placement positions 18 are positioned on each lateral side of the centerline 16 and adjacent the first card placement positions 14. Each second card placement position includes indicia for indicating a specific Ace so that a predetermined position for an Ace of each suit is provided on each lateral side of the playing surface 12.

Two third card placement positions 20 are disposed inwardly from each corner of the board 10 but laterally outwardly from the second card placement positions 18. Each third card placement position 20 is provided with indicia for indicating a specific King so that a predetermined position for a King of each suit is provided on each lateral side of the playing surface 12.

One fourth card placement position 22 is located centrally along and closely adjacent each side and end edge of the board 10. As will be later more fully described, cards dealt to each participant before play begins, are stacked face down on that participant's fourth card placement position 22.

One fifth card placement position 26 is located inwardly from and adjacent each fourth card placement position. The function of each fifth card placement position 15 will be explained more fully hereinafter.

Figure 2:
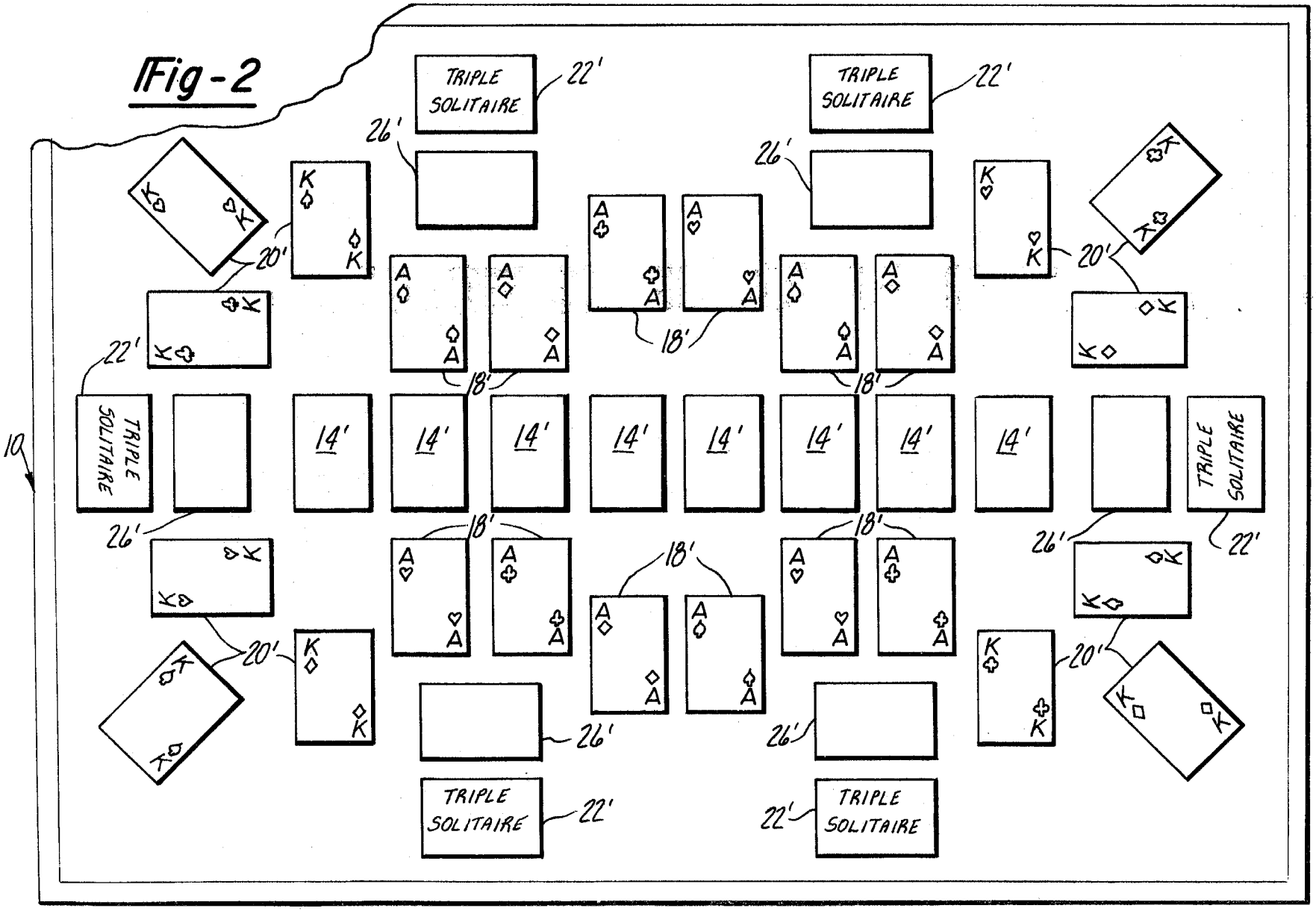
FIG. 2 is a top plan view of the game board of the present invention similar to FIG. 1 but showing a modification thereof.

The game board 10' illustrated in FIG. 2 is similar to that in FIG. 1 but is designed for use with "Triple Solitaire". Eight first card placement positions 14' are provided. Since three conventional card decks are used in the game, six second card placement positions 18' are provided on each lateral side of the row of first card placement positions 14' so that individual positions are provided for all of the twelve Aces in the playing deck. Three third card placement positions 20' are located inwardly from each corner of the playing surface thereby providing positions for all of the Kings in the playing deck. Six fourth card placement positions 22' are located near the perimeter of the playing surface 17. Two such positions 22' are provided along each longitudinal edge of the board 10' while one position 22' is centrally located along each transverse edge of the board 10'. One fifth card placement position 26' is located inwardly from and adjacent each fourth card placement position 22'.

Figure 3:
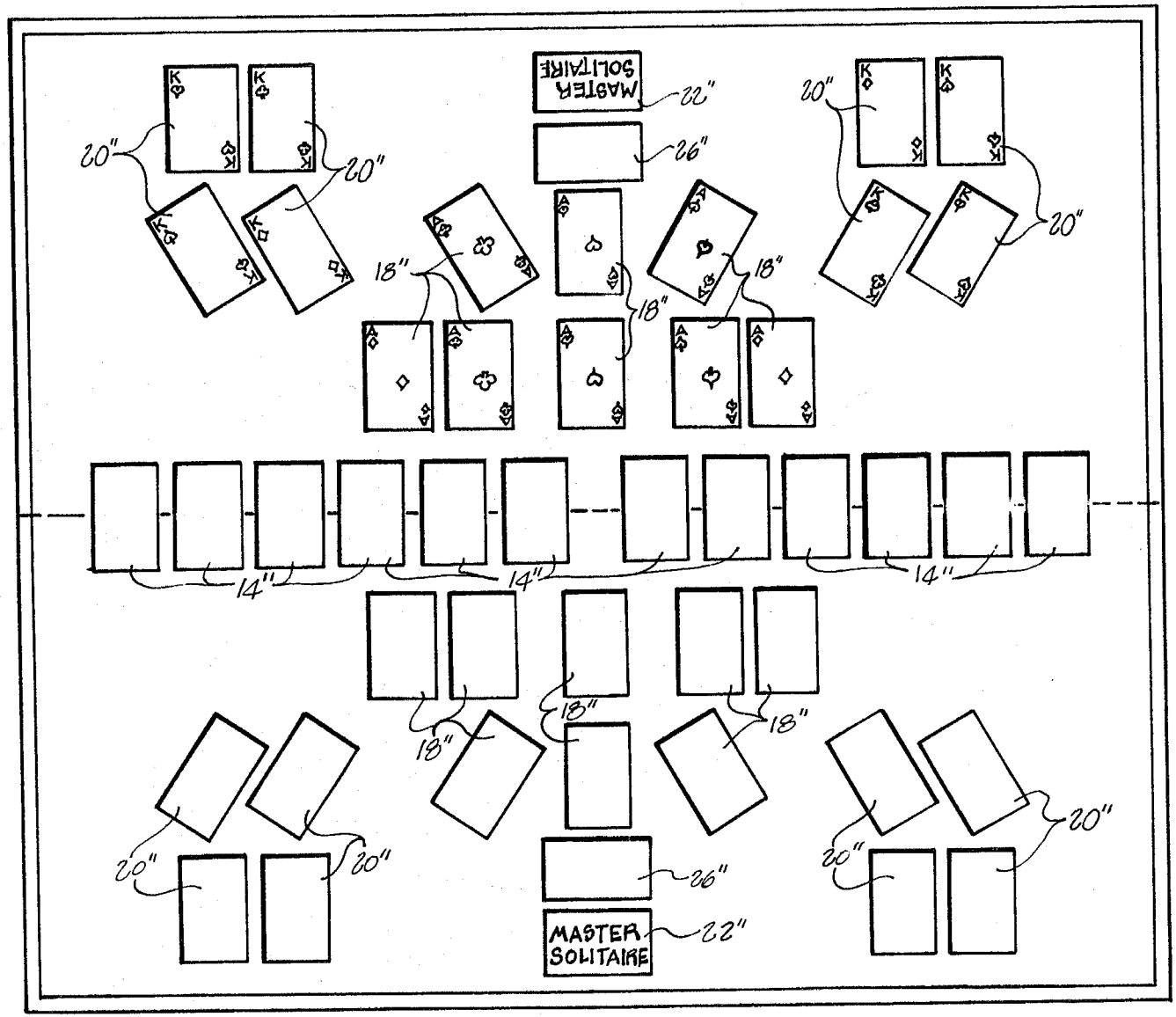
FIG. 3 is a top plan view of the game board of the present invention but showing a further modification thereof.

The "Master Solitaire" game board 10 (FIG. 3) is similar to the two described boards 10 and 10' but includes twelve first card placement positions 14'' in substantially the same arrangement as the positions 14 and 14' in the above examples. Master Solitaire utilizes four conventional card decks for the playing deck and, therefore, requires sixteen second card placement positions 18'' and sixteen third card placement positions 20'' arranged in substantially the same manner as the card placement positions 18 and 20, respectively, in the previous examples. Although four conventional decks are used, "Master Solitaire" was originally designed for only two players. Consequently, only one fourth card placement position 22'' is located centrally along each longitudinal edge of the game board. Similarly, one fifth card placement position 26'' is located inwardly from and adjacent each fourth card placement position 22''.

In order to more clearly explain the operation of the game board apparatus, the manner of play will be described in relation to the game board 10 shown in FIG. 1 and used for "Double Solitaire", although the rules of play are essentially the same for all the described examples. The game is commenced as follows:

A dealer combines and shuffles two conventional decks of playing cards to form the playing deck for the game. The dealer places the top four cards of the shuffled playing deck on the playing surface 12 by placing one card face up in each of the positions 14. He then deals the remaining cards to the other participants and himself. Each participant stacks the cards face down on his particular fourth card placement position 22.

The first participant sealed clockwise of the dealer commences play. Ify any Aces or Kings are exposed or show on any of the first placement positions 14, the first player will move it to the corresponding second or third placement position 18 or 20, respectively. Moreover, throughout the entire game, whenever an Ace or King is exposed, it is immediately playable on the corresponding card placement position 18 or 20, respectively.

Secondly, if any exposed card is playable on another exposed card it must be played before the first player is allowed to play the top card from the stack in his fourth card placement position. A card is playable if it is consecutively smaller numerically than and of the opposite color from a card exposed on a first or third placement position 14 or 20 or if it is consecutively larger numerically and of the same suit as an Ace exposed on its corresponding second placement position 18.

Once all possible moves have been completed with the previously exposed cards, the first player will expose the top card of his stack and attempt to play it. If it is not playable on the top card on a first placement position 14 or one of the second or third placement positions 18 or 20, it may be placed on a first placement position 14 that has been vacated. If it cannot be played in one of the above ways, it is placed face up on that player's fifth placement position 26. Conversely, if the card was playable in one of the above ways, subsequent cards from the player's stack on his fourth position 22 can be overturned and played until a card is encountered which can only be played on the player's fifth placement position. At this time the player's turn ends.

If at any time during a player's turn he fails to recognize or exercise a possible play, he immediately loses his turn. In addition, he receives one card from each of the other participants and places them face down at the bottom of the card stack on his fourth placement position 22.

After the first player has completed or lost his turn, the second player proceeds in essentially the same manner, playing all exposed cards before exposing one from the card stack on his fourth placement position 22. However, if the card exposed by the second player is not playable on the top card of one first placement position 14 or on a second or third placement position 18 or 20, and it cannot be used to fill a vacated first placement position 10, the second player has another option. The card can be played on the first player's fifth card placement position 26 if it is either consecutively smaller or consecutively larger numerically than but of the opposite color from the top card exposed in the first player's fifth card placement position 26. If this cannot be done, the second player will place the card face up in his own fifth card placement position 26 and his turn ends.

The third player proceeds substantially in the same manner as described above except that, if he is unable to play the card he exposed during his turn on the first, second or third placement positions, as previously described, he can play it on the fifth card placement position 26 of any opponent if it is consecutively larger or smaller numerically than but of the opposite color from the top card on and opponents' fifth card placement position 26. If it cannot be so played, the third player will place the card in his own fifth card placement position 15. The dealer, the fourth player, then proceeds in a similar manner and play continues from player to player in a clockwise direction.

Although a player can place a card on an opponent's fifth card placement position if he has no other possible plays and it is in fact playable on the top card exposed there, he may not remove any cards from an opponents' fifth card placement position in order to make more plays and thereby extend the duration of his turn. Only the participant can remove cards from his own fifth card placement position 26 and he must play them if possible before exposing a card from his fourth card placement position 22 during his turn.

The first player to distribute all the cards in both his fourth placement position 22 and his fifth placement position 26 is the winner. If a player has removed all of the cards from his fourth card placement position 22 and one turn passes him by because he is unable to play the top card on his fifth placement position 26, at his next turn if the card is still unplayable, he can elect to invert the stack accumulated there and place it face down on his fourth placement position 26. He may then turn over the top card and proceed as he did in the beginning of the game.

It can, therefore, be seen that the present invention provides a game and game board for multiplayer Solitaire which is challenging and permits orderly play of the game. Moreover, the failure of one player to execute a play opportunity does not unduly hinder the other players.

Having described my invention, many modifications thereto may become apparent to one skilled in the art without departing from the scope and spirit of the appended claims.

I claim:

1. A game apparatus used in conjunction with four conventional decks of playing cards and in which two persons compete against each other, said apparatus comprising:

a substantially rectangular playing surface, means for defining a row of twelve first card placement positions linearly spaced along a longitudinal centerline of said playing surface upon which cards are accumulated face up in consecutively ascending numerical order but consecutively alternating color, means for defining eight second card placement positions on each side of said centerline, transversely adjacent to but spaced apart from said row of first card placement positions, upon which Ace cards are first laid face up and upon which cards of the same suit as the Ace first laid are subsequently accumulated face up in consecutively ascending numerical order, means for defining four third card placement positions at each corner of said playing surface upon which King cards are first laid face up and upon which cards are subsequently accumulated face up in consecutively descending numerical order and consecutively alternating color, means for defining two fourth card placement positions located laterally on each side of said centerline and substantially midway and closely adjacent the longitudinal edges of said playing surface wherein cards dealt to each player are stacked face down, and means for defining two fifth card placement positions, adjacent to but spaced laterally inwardly from said fourth card placement positions wherein cards not playable on any of said first, second or third card placement positions are laid face up on said fifth position until playable.

2. The apparatus of claim 1 wherein each said means for defining each of said card placement positions is in the form of an outline substantially the same size as a conventional playing card.

3. A game apparatus used in combination with three conventional decks of playing cards in which from two to six players may participate comprising:

a substantially rectangular playing surface, means for defining a row of eight first card placement positions linerally spaced along a longitudinal centerline of said playing surface and upon which cards are accumulated face up in consecutively descending numerical order and alternating color, means for defining six second card placement positions on each lateral side of said centerline, adjacent to but spaced laterally outwardly from said row of first card placement positions and upon which Ace cards are first laid face up and upon which cards of the same suit as the Ace card are subsequently accumulated in consecutively ascending numerical order, means for defining three third card placement positions spaced diagonally inward from each of the four corners of said playing surface and spaced adjacent to the end of said row of first card placement positions and upon which King cards are first laid face up and upon which cards are subsequently accumulated in consecutively descending numerical order and consecutively alternating color, means for defining six fourth card placement positions, two of said fourth card placement positions being longitudinally spaced along each longitudinal edge of said playing surface and one said fourth card placement position being positioned substantially centrally along each transverse edge of said playing surface and upon which cards dealt to each player are laid face down, and means for defining six fifth card placement positions, each of which is adjacent to but spaced inwardly from each fourth card placement position and upon which cards not playable on any of said first, second or third card placement positions are to be laid face up until playable.

4. The apparatus of claim 3 wherein each of said means for defining a card placement position is in the form of an outline substantially the same size as a conventional playing card.

5. The invention as defined in claim 1 and further comprising four conventional decks of playing cards.

6. The invention as defined in claim 3 and further comprising three conventional decks of playing cards.

7. A game apparatus used in combination with two conventional decks of playing cards and with which from two to four players can participate comprising;

a substantially rectangular playing surface, means for defining a row of four first card placement positions linearly spaced along a longitudinal center line of said playing surface, upon which cards are accumulated face up in consecutively ascending numerical order but consecutively alternating color, means for defining four second card placement positions on each side of said center line substantially transversely adjacent to but spaced apart from said row of first card placement positions, upon which face cards are first laid face up and upon which cards of the same suit as the Ace first laid are subsequently accumulated face up in consecutively ascending numerical order, means for defining two third card placement positions spaced substantially diagonally inwardly from each of the four corners of said playing surface and spaced substantially adjacent to the end of said row of first card placement positions, and upon which King cards are first laid face up and upon which cards are subsequently accumulated face up in consecutively descending numerical order and consecutively alternating color, means for defining four fourth card placement positions, each fourth card placement position being placed at substantially the center of, and adjacent to, an edge of the playing surface, and upon which the cards dealt to each player are stacked face down, and means for defining four fifth card placement positions, each fifth card placement position being placed adjacent to but spaced inwardly from each fourth card placement position, and upon which cards not playable on any of said first, second or third card placement positions are laid face up until playable.

8. The invention as defined in claim 7 and further comprising two conventional decks of playing cards.

9. The apparatus defined in claim 1 wherein each said means for defining each of said second and each of said third card placement positions comprises indicia to designate the particular card which is to be first laid thereon.

10. The apparatus defined in claim 3 wherein each said means for defining each of said second and each of said third card placement positions comprises indicia to designate the particular card which is to be first laid thereon.

11. The apparatus defined in claim 7 wherein each said means for defining each of said second and each of said third card placement positions comprises indicia to designate the particular card which is to be first laid thereon.

* * * * *

UNITED STATES PATENT AND TRADEMARK OFFICE

CERTIFICATE OF CORRECTION

PATENT NO. : 4,184,684

DATED : January 22, 1980

INVENTOR(S) : Lyle L. Cramer

It is certified that error appears in the above-identified patent and that said Letters Patent are hereby corrected as shown below:

Column 4, line 64, delete "sealed" and insert --seated-- therefor;

Column 4, line 65, delete "Ify" and insert --If-- therefor.

Signed and Sealed this

*Thirteenth* Day of *May 1980*

[SEAL]

*Attest:*

SIDNEY A. DIAMOND

*Attesting Officer*

*Commissioner of Patents and Trademarks*